United States Patent [19]

Daniels

[11] Patent Number: 4,912,778

[45] Date of Patent: Apr. 3, 1990

[54] HEAT REFLECTIVE SKULL CAP SHIELD FOR USE IN HARD HATS

[76] Inventor: Darleen Daniels, P.O. Box 1221, Port Neches, Tex. 77651

[21] Appl. No.: 334,463

[22] Filed: Apr. 7, 1989

[51] Int. Cl.[4] ..... A42B 3/00

[52] U.S. Cl. ..... 2/7; 2/416

[58] Field of Search ..... 2/7, 5, 416, 410, 417, 2/418, 419, 8, 6, 190

[56] References Cited

U.S. PATENT DOCUMENTS

| | | | |
|---|---|---|---|
| 2,357,851 | 9/1944 | Scheyer . | |
| 2,381,524 | 8/1945 | Taylor | 2/7 |
| 3,015,103 | 1/1962 | Zbikowski | 2/416 |
| 3,223,086 | 12/1965 | Denton | 2/171.3 X |
| 3,535,706 | 10/1970 | Aileo | 2/5 |
| 3,594,814 | 7/1971 | Schuessler | 2/205 X |
| 4,397,045 | 8/1983 | Schonwetter et al. | 2/5 |
| 4,619,003 | 10/1986 | Asbury | 2/5 |
| 4,627,114 | 12/1986 | Mitchell | 2/420 X |
| 4,656,667 | 4/1987 | Blake | 2/5 |
| 4,829,599 | 5/1989 | Giorgio et al. | 2/416 |

FOREIGN PATENT DOCUMENTS 397985 9/1933 United Kingdom .

*Primary Examiner*—Peter Nerbun

*Attorney, Agent, or Firm*—A. Robert Theibault

[57] ABSTRACT

The present disclosure is directed to a heat reflective shield having a plurality of spherical triangular panels each having aluminum foil on one side and a heat resistant fabric adhered to the other side, for use with a hard hat. The panels are stitched together along their long sides and along their bases with binding tape to define an equatorial stitched bound base border to form a highly reflective side of the shield directed upwardly toward the crown of the hard hat thus forming a reflective heat shield to direct the heat from the sun or other hot heat sources away from the skull of the wearer of the hard hat. A strip of double sided adhesive tape is provided, one side of which is adapted to be adhered to the outside of the top of the heat reflective skull cap and the other side of which is adapted to adhere to the inside of the crown of the hard hat. An adjustable hat band is secured within the hard hat positioned to lie between the hard hat shell and the head of the wearer, and suspension bands are secured to the hat band at their ends with their intermediate portions flex arched to form supports to keep the heat reflective skull cap supported above and out of contact with the head of the wearer.

1 Claim, 2 Drawing Sheets

HEAT REFLECTIVE SKULL CAP SHIELD FOR USE IN HARD HATS

TECHNICAL FIELD

My invention relates to a skull cap heat reflective shield for use in the crown of hard hats to protect the wearer from heat radiating from the sun or other heat sources.

BACKGROUND ART

Heretofore, many forms of liners have been proposed for use in hard hats. Some liners are resistant to heat and some are lined to protect the wearer from cold. The closest art known to me prior to this application are:

| British Specification 239,371, of Sept. 10, 1925, British Specification 397,985, of Sept. 7, 1933, U.S. Pat. Nos. | |
|---|---|
| 2,357,851 | 2,381,524 |
| 3,223,086 | 3,535,706 |
| 3,594,814 | 4,397,045 |
| 4,619,003 | |

SUMMARY OF THE INVENTION

In accordance with my invention I provide a removable and replaceable heat reflective shield in the form of a skull cap made up of a plurality of spherical triangular panels having aluminum foil on one side and a heat resistant fabric adhered to the other side. The panels are stitched together along their long sides and along their bases with binding tape to define an equatorial stitched bound base bordered skull cap having the highly reflective side of the shield directed upwardly toward the crown of the hard hat to form a reflective heat shield to direct the heat away from the skull of the hard hat wearer. The skull cap is retained in place at its top by double sided adhesive tape and from beneath by arched flexed semi rigid support straps which are attached to the inside hat band of the hard hat. The suspension bands lying beneath the skull cap heat reflective shield keep the skull cap supported above and out of contact with the head of the hard hat wearer.

This is particularly advantageous when working on a construction site in the hot sun where no shade is available and as much heat as possible is to be directed away from the head of the wearer.

BRIEF DESCRIPTION OF THE FIGURES OF DRAWINGS

BEST MODE FOR CARRYING OUT THE INVENTION

Figure 1:
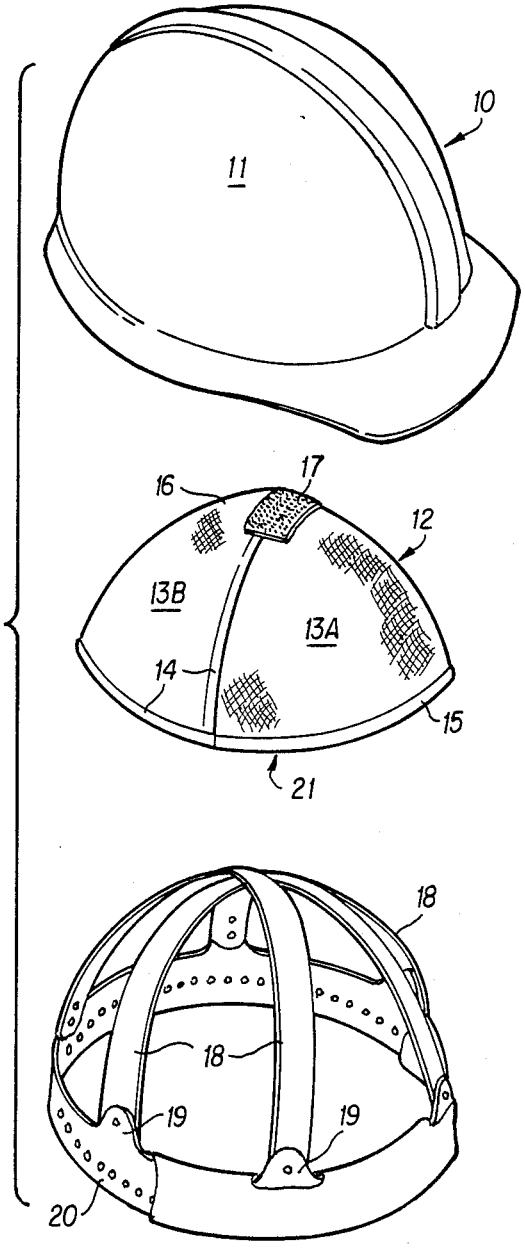
FIG. 1, is an exploded perspective view of a hard hat having the heat reflective skull cap shield and hat band equipment with flex arched suspension bands secured to the adjustable head band to keep the skull cap from contacting the head of the wearer.
Figure 2:
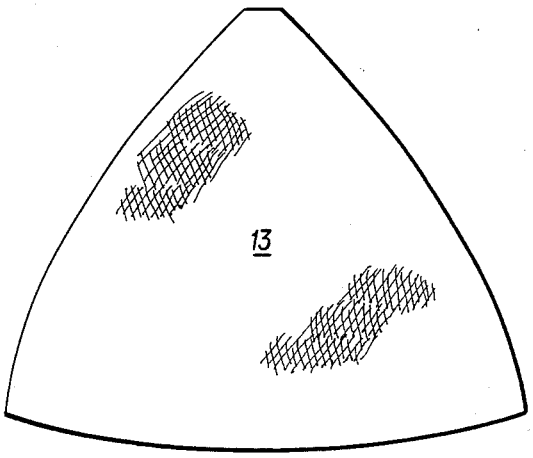
FIG. 2, is a plan view of a spherical triangular panel employed in making up the heat reflective skull cap shield of the present invention.

Referring now to the drawings, FIGS. 1, 2 and 4, 10 designates a hard hat of either a shell of high impact plastic or of a plastic reinforced with fibers of random orientation designed to withstand blows to the head without injury to the skull.

Figure 3:
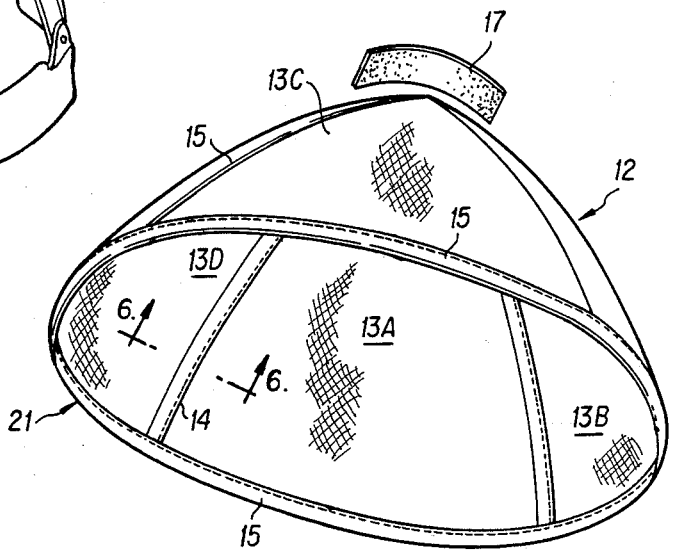
FIG. 3, is an underside perspective view of an assembled heat reflective skull cap shield of the present invention with adhesive attaching tape.
Figure 5:
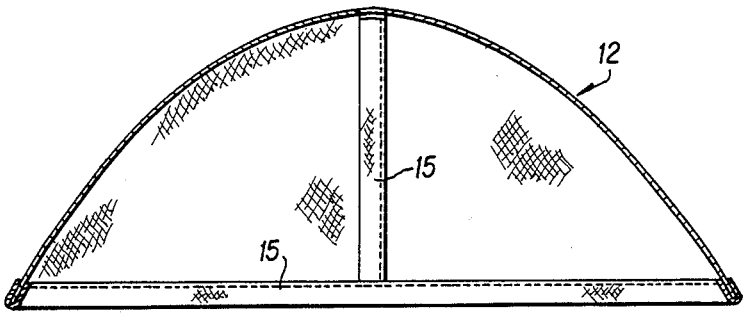
FIG. 5, is a side elevational view of the heat reflective skull cap shield of the present invention.
Figure 6:
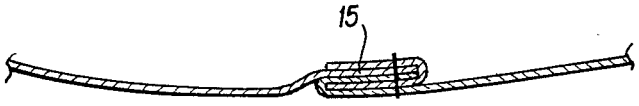
FIG. 6, is a fragmentary sectional view of the stitch joining of the spherical triangular panels with binding tape taken at an enlarged scale on the lines 6—6 in FIG. 3.

Located within the crown 11 of the hat 10 is a heat reflective shield in the form of a skull cap 12 made up of spherical triangular panels 13 having highly reflective aluminum foil 13A on one side and a heat resistant fabric 13B on the other side. A plurality of panels 13 are stitched at 14 with binding tape 15 as best seen in FIGS. 3, 5 and 6 to form the skull cap 12 with the highly reflective side outwardly and upwardly. At the crown 16 of the skull cap 12 best seen in FIGS. 1 and 3 is located a strip of two sided adhesive tape 17 one side to adhere to the external crown of the skull cap 12, see FIGS. 1 and 3 and the other side of the tape to adhere to the inside of the crown 11 of the hard hat 10.

The skull cap 12 is supported from beneath by arch flexed semi-rigid support straps 18 secured to lobes 19 on the inside adjustable hat band 20 which is secured to the inside of the hard hat 10 to shock mount the shell of the hard hat on its wearer to protect his skull from damage.

Figure 4:
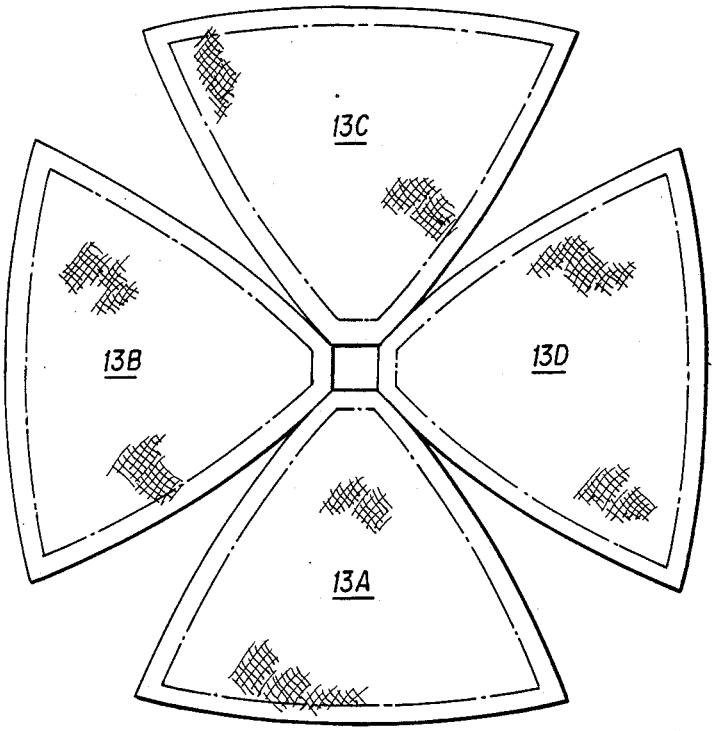
FIG. 4, is a schematic layout plan view of spherical triangular panels for making up the heat reflective skull cap shield of the present invention the panel area taken up by binding tape stitching being shown in dash lines in formation of the heat reflective skull cap shield for protecting the head of the wearer.

Refering now to FIGS. 4, 5 and 6 the layout of the skull cap 12 is shown wherein spherical triangular panels 13A, 13B, 13C and 13D are sewn together with the binding tape 15. After the sewing is completed the result is a highly reflective stitch bound base bordered skull cap 12 having an equatorially bound base 21, giving the skull cap 12 a finished appearance.

FIG. 3 shows the completed insulator skull cap 12.

What I claim is:

1. For use with a hard hat shell of high impact plastic or plastic reinforced fibers of random orientation to withstand blows to the head of the wearer without permitting injury to the skull, a heat reflective shield comprising a plurality of spherical triangular panels having aluminum foil on one side and a heat resistant fabric adhered to the other side, said panels being stitched together along their long sides and along their bases with binding tape to define an equatorial stitched bound base border to form a highly reflective side of the shield directed upwardly toward the crown of the hard hat thus forming reflective heat shield to direct the heat from the sun or other hot heat sources away from the skull of the wearer of the hard hat, a strip of double sided adhesive tape one side of which is adapted to be adhered to the outside of the top of the heat reflective shield and the other side of which is adhered to the inside of the crown of the hard hat, an adjustable hat band secured within the hard hat positioned to lie between the hard hat shell and the head of the wearer, and suspension bands secured to the hat band at their ends with their intermediate portions flex arched to form supports to keep the heat reflective shield supported above and out of contact with the head of the wearer.

* * * * *